US005573083A

United States Patent [19]

Fletcher et al.

[11] Patent Number: 5,573,083

[45] Date of Patent: Nov. 12, 1996

[54] IN-GROUND AUTOMOTIVE LIFT SYSTEM

[76] Inventors: Robert H. Fletcher, 5215 Fiore Ter., San Diego, Calif. 92122; Glenn Felpel, 4917 Macmont Cir., Powell, Tenn. 37849

[21] Appl. No.: 398,992

[22] Filed: Mar. 6, 1995

Related U.S. Application Data

[63] Continuation-in-part of Ser. No. 194,058, Feb. 8, 1994, Pat. No. 5,404,968.

[51] Int. Cl.[6] ..... B66F 7/00

[52] U.S. Cl. ..... 187/205; 187/210

[58] Field of Search ..... 187/205, 210, 187/218, 267, 268; 254/92, 93 L

[56] References Cited

U.S. PATENT DOCUMENTS 5,259,482 11/1993 Proulx et al. ..... 187/205

*Primary Examiner*—Kenneth Noland
*Attorney, Agent, or Firm*—M. K. Silverman

[57] ABSTRACT

An automotive lift system includes a vertically elongated in-ground environment-defining canister having an upwardly directed mouth, an automotive lift, an assembly for selectable detachable suspension of said lift situated substantially upon and about the mouth of the canister, an in-ground anchor of the assembly relative to reactive forces generated by the lift and communicated therefrom through the suspension assembly to the anchor.

14 Claims, 7 Drawing Sheets

IN-GROUND AUTOMOTIVE LIFT SYSTEM

REFERENCE TO RELATED APPLICATION

This case is a continuation-in-part of application Ser. No. 08/194,058, filed Feb. 8, 1994 now U.S. Pat. No. 5,404,968.

BACKGROUND OF THE INVENTION

The present invention relates to automotive lift systems and, more particularly, automotive lift systems in which the lifting means thereof must be situated at a below-ground level relative to the plane or level at which the automotive technicians are to operate.

In the prior art of automotive lifts it is commonplace to sink the housing of a hydraulic lift assembly in-ground at the automotive work site so that only the extensible portion of the lift means is visible to the automotive technicians. It is also known in the art to provide a so-called pit or trench about the area or location of a hydraulic lift to provide for use in installation and servicing of the lift assembly. In such systems the means of stabilization of the lift means relative to the ground or surface level bears no relationship to the pit or trench within which the lift means is located. In other words, in the prior an of automotive lift systems, it is typical to either embed the entire hydraulic lift assembly within the ground or to provide a massive ground level platform, typically of steel or concrete, from which the hydraulic or lift assembly is suspended. Examples of such art appear in U.S. Pat. No. 2,015,357 (1936) to Weaver, and No. 2,588, 518 (1952) to Grushon.

In addition the prior art, as best known to the inventor, does not provide any system having environment-defining in-ground regions within which an automotive lift assembly maybe mounted, nor does there exist automotive lift assembly suspension means having an integrated relationship to any environment-defining region about the lift assembly, whether such means be hydraulic or non-hydraulic.

A consequence of the state of the art, as above set forth, is that the inground environment surrounding an automotive lift site is susceptible to chronic leaking, fluid contamination and the like, with attendant inevitable release or oozing of liquid from any hydraulic system. Further, the serving of in-ground hydraulic systems, whether or not provided with a pit or trench of the above-referenced type, is typically an awkward and time consuming operation. Further, the use of ground support means for hydraulic lift systems having no mechanical relationship to the pit or trench area has acted to increase the cost of automotive lift systems and to render more difficult access to portions of such systems as the same typically becomes necessary, over time, to accomplish servicing and repair of such systems. As such, in many prior art automotive lift configurations, it is not unusual, in order to effect given repairs of a faulty system, for service personnel to be required to jackhammer out large areas of concrete support means to gain access to the necessary portions of a hydraulic lift system. Accordingly, the effectuation of major repair to state of the art hydraulic systems typically involves commitment of much time (on the order of many days) and dollars.

Further, prior art in-ground automotive lift systems cannot, in general, be repaired by a simple lifting of a hydraulic or other lift means off of a support journal, that is, the complete removal of the same from the pit or trench and the replacement thereof with a non-defective unit. Rather, in the art of record it is necessary to effect repairs of hydraulic lift systems in situ, as opposed to by the removal thereof from the pit or trench and the replacement thereof by a new or re-built lift means.

Also, as a result of the above set forth limitations in the art, it is, as a practical matter, not possible to relocate an automotive service station or other facility at which automotive lift means are employed.

The instant invention may therefore, may be viewed as a response to the many above set forth economic, practical and environment difficulties in the art.

SUMMARY OF THE INVENTION

The present invention constitutes an automotive lift system including a vertically elongated in-ground environment-defining canister having an upwardly directed mouth thereof; an automotive lift means; means for selectable detachable suspension of said lift means situated substantially upon and about said mouth of said canister; and means for in-ground anchoring of said suspension means relative to reactive forces generated by said lift means and communicated therefrom through said suspension means to said anchoring means.

It is, accordingly, an object of the invention to provide an in-ground lift system that will reduce the cost of maintenance associated therewith.

It is another object to provide a lift system of the above type that will minimize historic types of environmental risks associated with automotive lift systems.

It is a further object of the invention to provide an automotive lift system that will enable the removability of lift elements thereof and the replacement thereof with new or re-manufactured lift elements without need to effect in-ground repairs.

It is a yet further object to provide a lift system in which an environment-defining region about each lift means can be simply economically and reliably provided.

It is a still another object of the invention to provide an automotive lift system of the above type that is completely self-contained and self-lubricating.

It is a yet further object to provide a system in which the components thereof may be easily interchanged with each other.

It is still further object to provide a system that can be easily relocated as may be dictated by commercial and other considerations.

It is a yet further object to provide an automotive lift system in which an environment-defining canister will provide a perimeter of defense to the in-ground environment in the event of fluid or chemical leakage from the automotive lift system.

The above and yet other objects and advantages of the present invention will become apparent from the hereinafter set forth Brief Description of the Drawings, Detailed Description of the Invention and claims appended herewith.

DETAILED DESCRIPTION OF THE INVENTION

Figure 1:
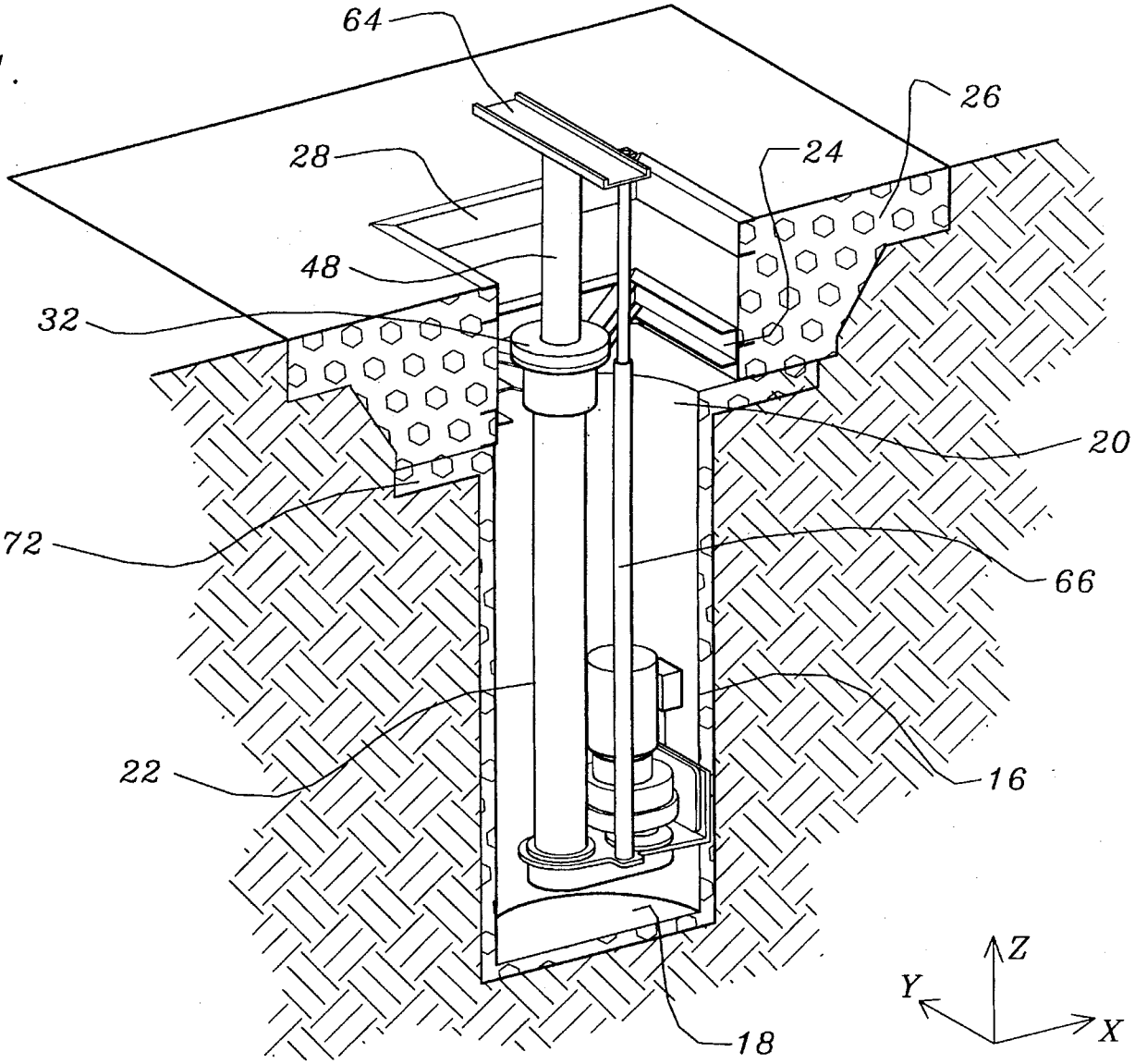
FIG. 1 is a cut-away view of an automotive lift system in accordance with the invention.

With reference to FIG. 1 there is shown an elongated in-ground environment defining canister 16 which extends to a depth 18. As may be noted, canister 16 is vertically elongated and exhibits an upwardly directed mouth 20.

Figure 2:
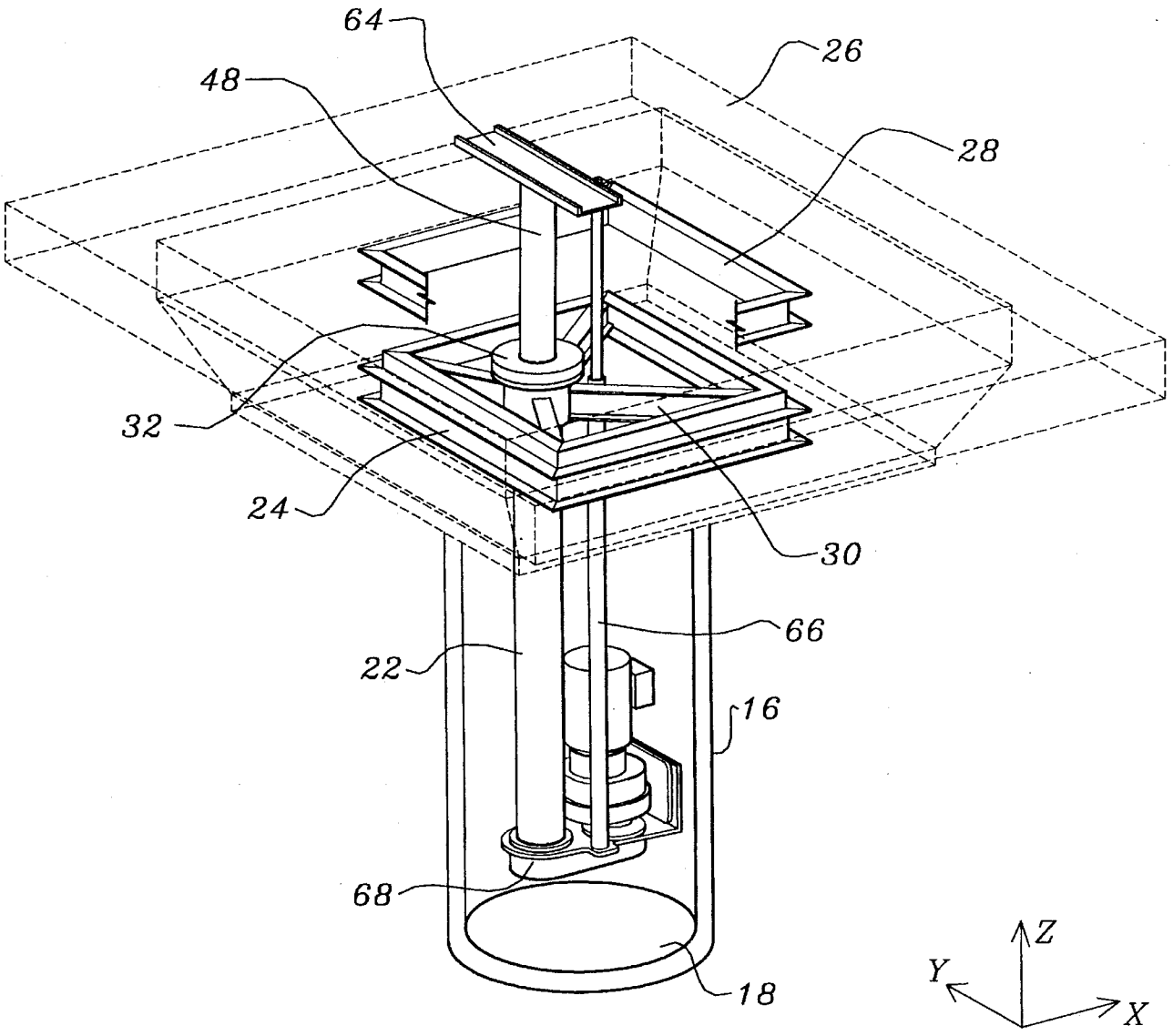
FIG. 2 is a schematic view of the system of FIG. 1.
Figure 3:
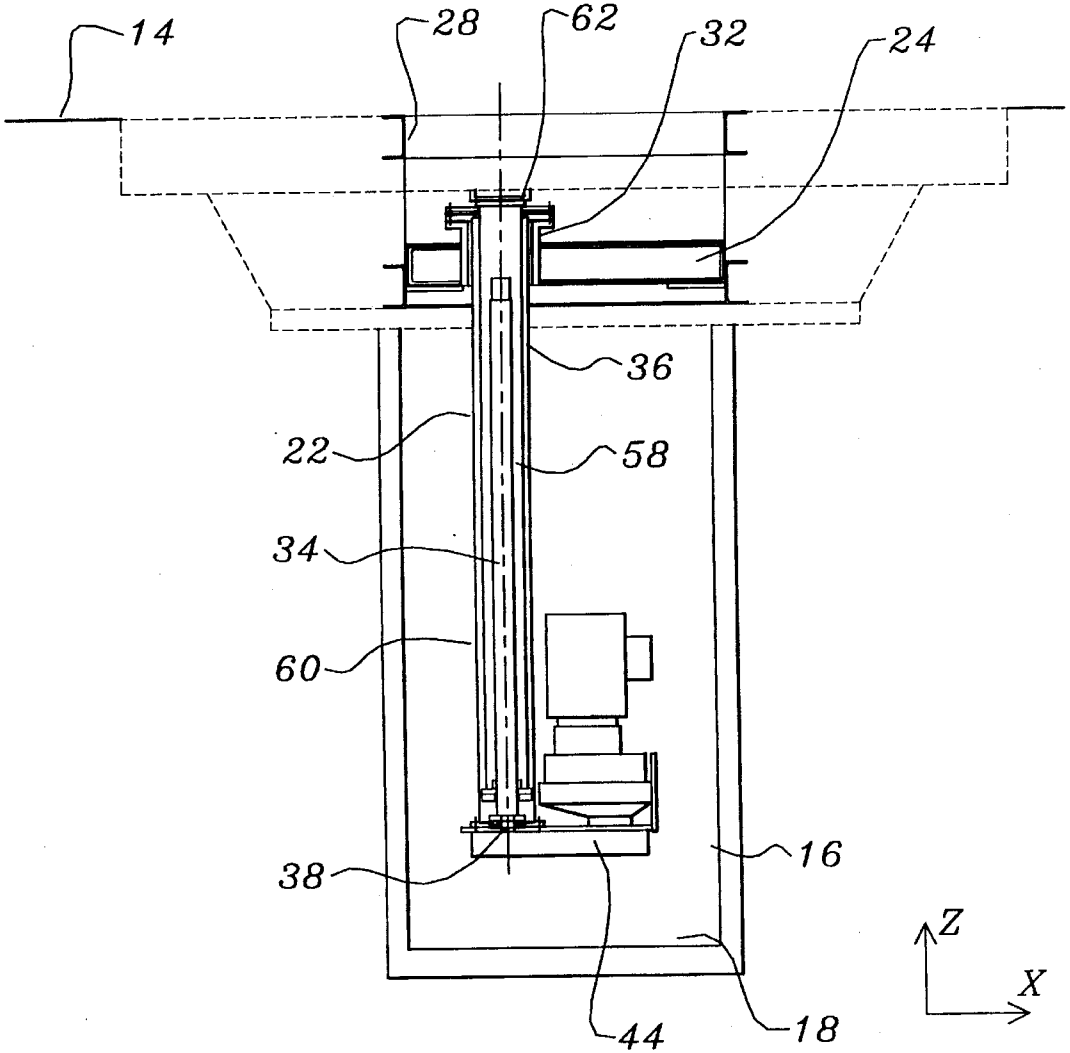
FIG. 3 is a longitudinal side cross-sectional view of the system of FIGS. 1 and 2 showing the position thereof in a retracted position.

As may be further noted, there is provided an automotive lift means 22 (later described below) which may be of either a hydraulic or non-hydraulic type. Said lift means 22 is suspended relative to canister 16 through the employment of means 24 for the selectable detachable suspension of said lift means 22. Said suspension means 24, as may be noted in the views of FIGS. 1 thru 3, is situated substantially about the uppermost portion of said mouth 20 of the canister 16. Further, said suspension means is embedded within a means 26 for in-ground anchoring of said suspension means 24 relative to reactive forces that are generated in the course of normal usage of said lift means 22 and which are communicated through said lift means 22 to said suspension means 24 and, in turn, to said anchoring means 26.

As may be noted in FIG. 1, anchoring means 26 will typically take the form of a massive concrete or other abutment within which is formed an opening 26 which substantially corresponds to the opening defined by said mouth 20 of the canister 16. The depth, mass, and configuration of anchoring means 26 relative to the structure of suspension means 24 is significant in optimizing the practice of the present invention in that, for the successful practice thereof, it is necessary that the depth and mass of the anchoring means 26 be sufficient to fully absorb the reactive forces of stress and compression which are communicated thereto from the lift means 22 and through suspension means 24, to thereby insulate the canister from such forces.

The structure of suspension means 24 may be more fully appreciated with reference to FIG. 2 wherein said means may be seen to include a horizontal truss, 26 having therein a vertical journal 28. Accordingly, as may be more particularly noted with reference to the view of FIG. 3, lift means 26 may be suspended within said journal 28 of the truss 26 of said suspension means 24.

With reference to the automotive lift means 22 it is to be appreciated that said lift means is representative of a generic class of such lift means and, as such, may include hydraulic as well as non-hydraulic lift assemblies.

With regard to the principles of operations of the specific lift means shown in the figures, namely, the lift means 22, it more particularly, includes various sub-assemblies. These may be seen in the enlarged views of FIGS. 4 and 6. Therein the, lift means of the preferred embodiment may be seen to include a screw drive 34 having an upper end 36 (see FIG. 3) and a lower end 38 which comprises a thrust bearing 40 (see FIGS. 4 to 6) and a first sprocket 42 from which a chain drive 44 is powered by a second sprocket 46 of a power drive 48. More particularly, power drive 48 includes a motor 50 which powers a gear box (not shown) which in turns provides rotation to bevel gears (not shown) which then rotate said sprocket 46 through said chain drive 44 thereby accomplishing the rotation of sprocket 42 and of said thrust bearing 40, thereby achieving a controllable selectable rotation of screw drive 34. It is noted that various mechanical equivalents may be used in lieu of said chain drive 44, said sprockets and said bevel gears.

Figure 5:
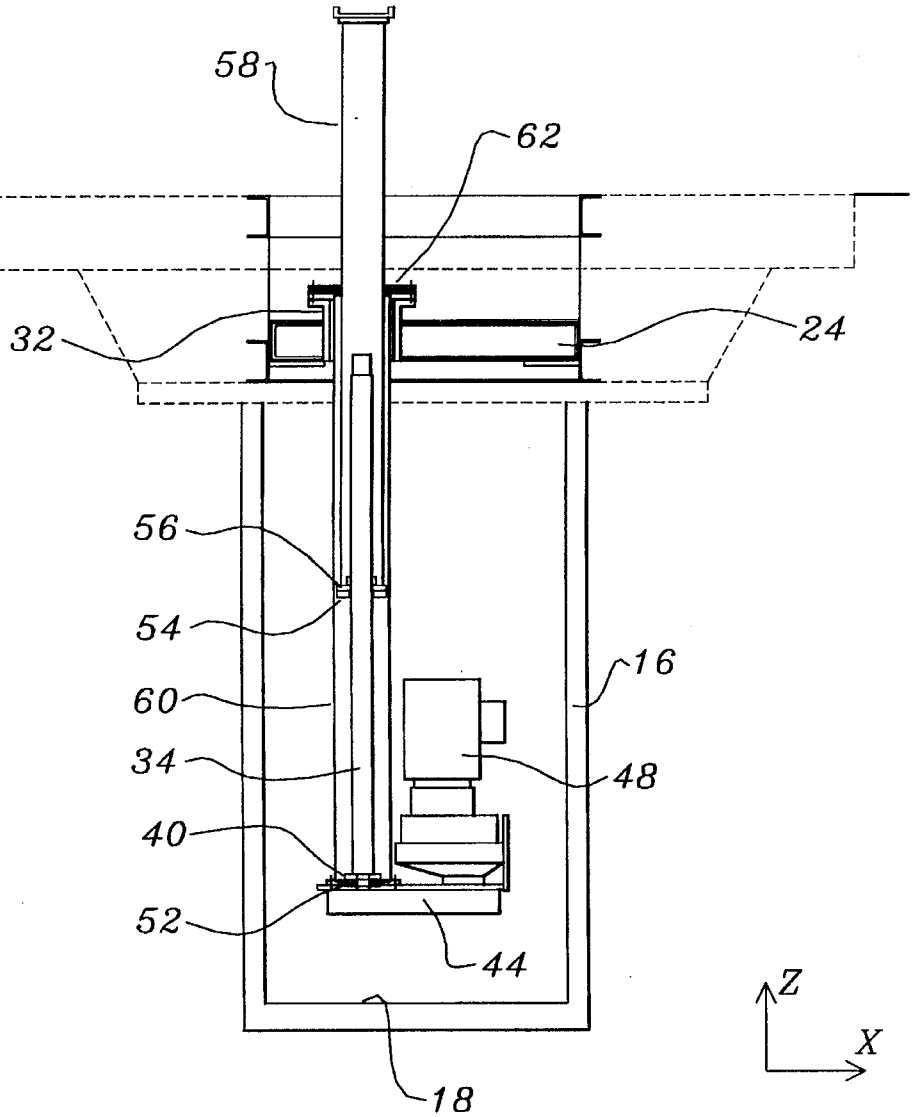
FIG. 5 is a longitudinal side cross-sectional view of the system of FIGS. 1 and 2 showing the piston thereof in an extended position.

With reference to FIG. 5, it is noted that, as a safety measure there is provided a shear key 52, the function of which is to enable a mechanical disassociation between screw drive 34 and the chain drive 44 in the event of an accidental over-rotation of the screw drive.

Figure 4:
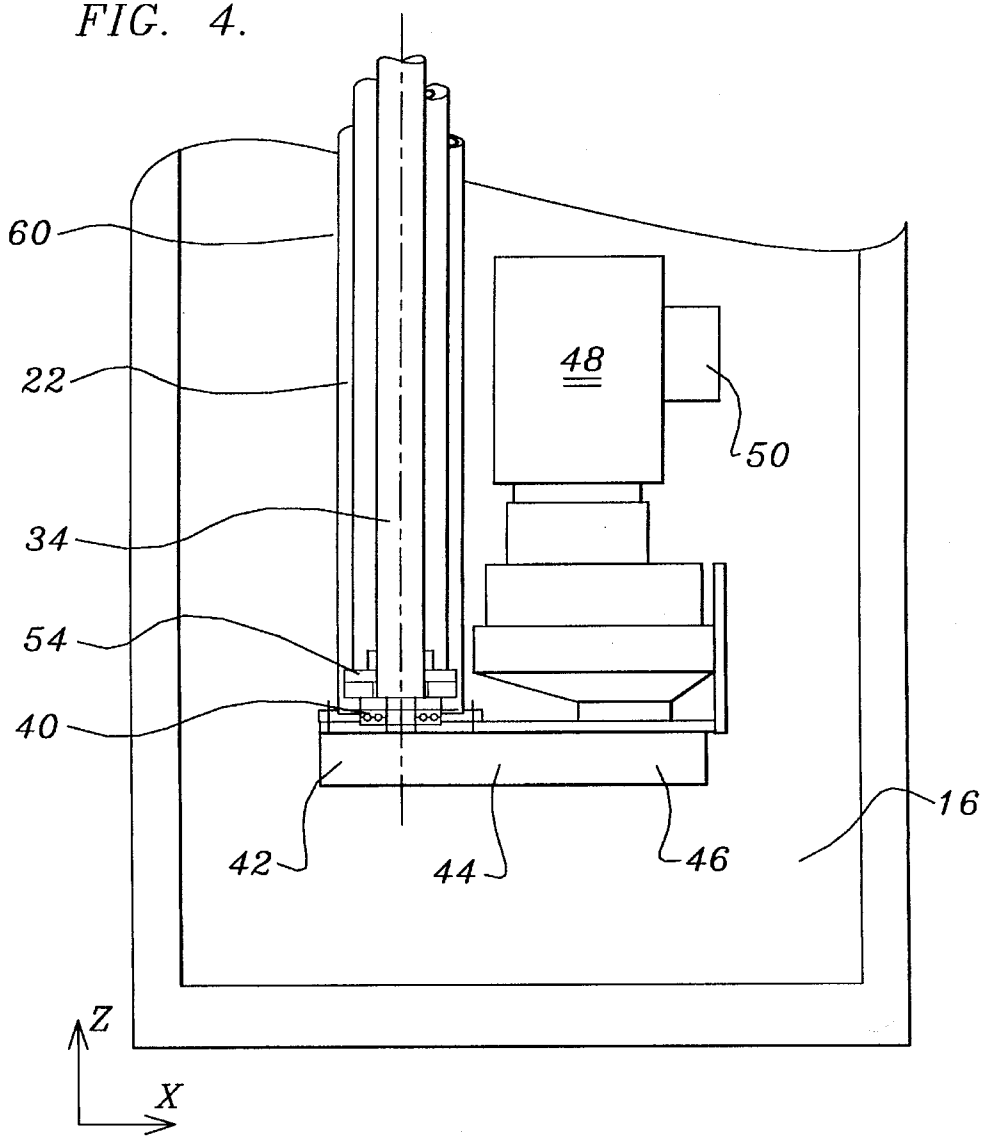
FIG. 4 is an enlarged view of the lower portion of FIG. 3.
Figure 6:
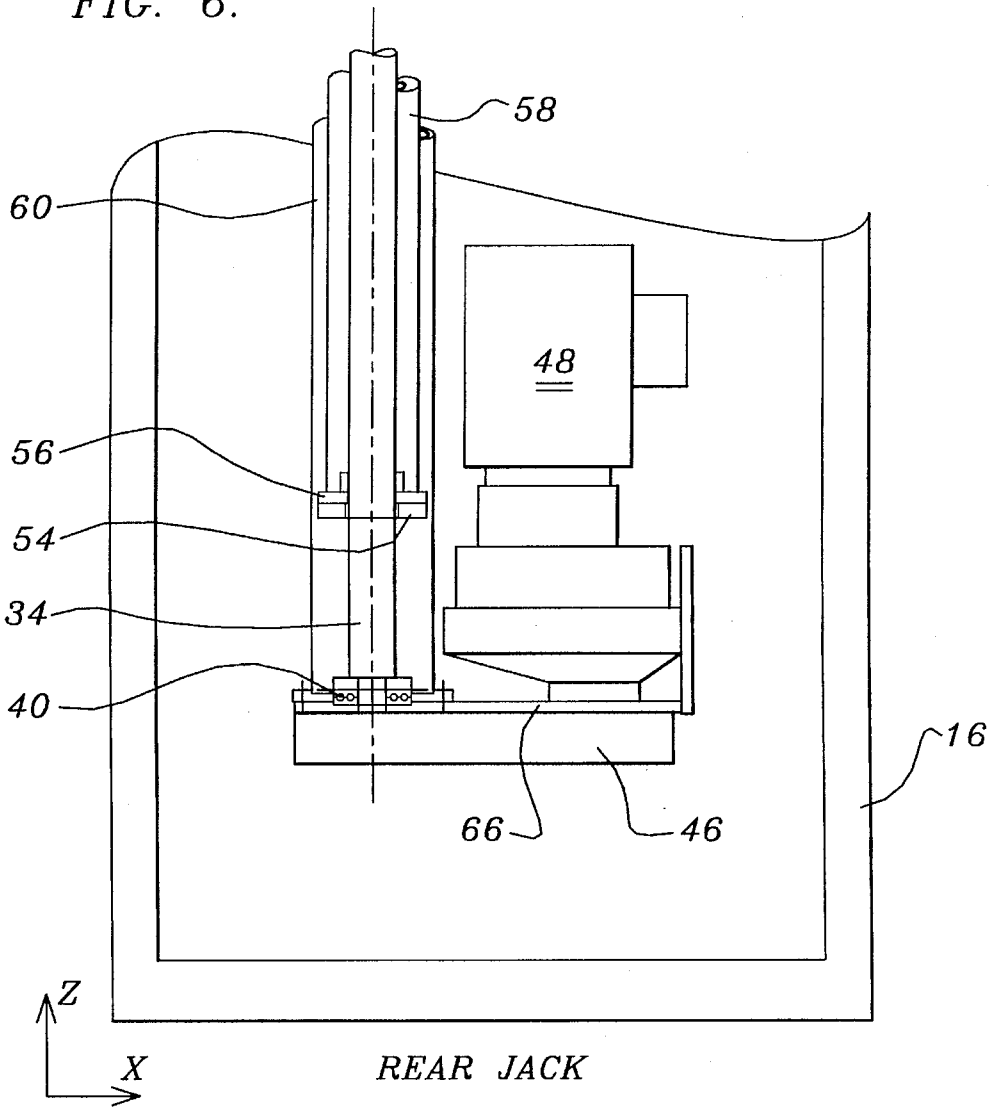
FIG. 6 is an enlarged view of the lower portion of FIG. 5.

As may be noted in FIGS. 5 and 6, which are sequential to the views of FIGS. 3 and 4, rotation of screw drive 34 will result in an upward movement of a load nut 54 which includes an annular flange 56 upon which rests a hollow piston 58. It is to be noted that piston 58 is positioned radially inwardly of a hollow cylinder 60 which is positioned about the screw drive 34 along substantially the entire length thereof between said power drive and said suspension means 24.

It may, thereby, be appreciated that piston 58 will, because it is resting upon load nut 54, be elevated relative to the bottom 18 of canister 16 as a function of the rotation of screw drive 34 caused by the power drive 48.

At the top of cylinder 60 is provided an annular flange 62 which enables the entire screw lift assembly to be suspended upon journal 32 of suspension means 24.

As may be seen in the views of FIGS. 1 and 2, the uppermost portion of piston 48 is provided with an automotive wheel interface means 64. Also shown in said Figures is a stabilization bar 66, the function of which is to assure that wheel interface means 64 cannot rotate relative to surface 68 of the power drive.

Figure 7:
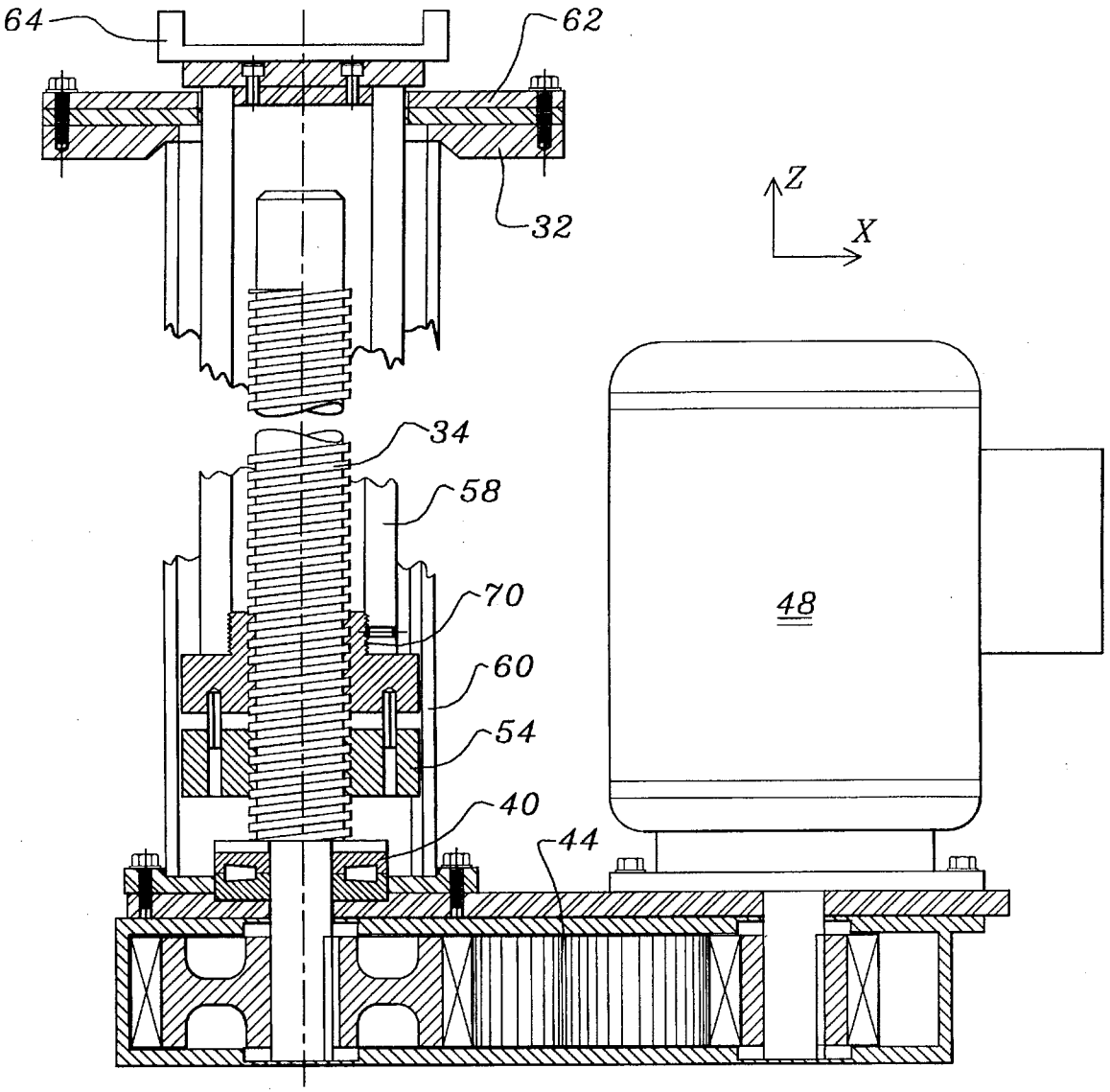
FIG. 7 is a detailed view of the power means of the embodiment of FIGS. 1 thru 6.

With reference to the view of FIG. 7, there is shown, in longitudinal cross-section, an assembly view which corresponds substantially to the schematic views of FIGS. 5 and 6.

It is, therefore, to be appreciated that, while load nut 54 is in screwthreadable relationship to screw drive 34, it is mounted non-rotationally relative thereto because its rotation is precluded by securement of annular surface 70, as may be seen with reference to FIG. 7

With further reference to FIG. 1, the in-ground environment- defining canister 16 may be formed of any of a plurality of different materials. One such material may simply be that of a pre-cast concrete pipe in which a lowermost surface 18 has been molded or otherwise provided thereto. Also, an upper annular flange 72 may optionally be provided to effect a larger surface for communication with the lower portion of anchor means 26.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention what I claim as new, useful and non-obvious and, accordingly, secure by Letters Patent of the United States is:

1. An automotive lift system, comprising:

(a) a vertically elongated in-ground environment-defining canister having an upwardly directed mouth thereof;

(b) an automotive lift means;

(c) means for selectable detachable suspension of said lift means situated substantially upon and about said mouth of said canister, said lift means comprising an assembly having an extensible mode and a contracted mode, an upper circumferential end of said lift means including flange means complementally positionable about a journal of said suspension means to effect a suspension of lift means within said journal, said lift means further including vehicle interface means secured upon an upper end of said extensible assembly; and (d) means for in-ground anchoring of said suspension means relative to reactive forces generated by said lift means and communicated thereto through said suspension means.

2. The system as recited in claim 1, said canister comprising:

a pre-cast concrete pipe sealed at an end thereof opposite from said mouth of said canister.

3. The system as recited in claim 1, in which said suspension means comprises:

a horizontal truss included vertical journal means therein.

4. The system as recited in claim 1, in which said anchoring means comprises:

a slab of rigid material extending from substantially ground level to substantially a level of said suspension means.

5. The system as recited in claim 1, in which said assembly comprises:

a screw drive having an upper end and a lower end, said lower end including an annular thrust bearing;

power means for imparting selectable rotation to said drive screw, said means in mechanical linkage to said thrust bearing of said screw drive;

a load nut screw-threadably and non-rotationally mounted upon said screw drive;

a hollow cylinder positioned about said screw drive along substantially the entire length thereof, said cylinder non-rotationally linked to said load nut; and a hollow piston having an upper end and a lower end, positioned radially inwardly of said cylinder, having said lower end thereof rigidly mounted onto said load nut.

6. The system as recited in claim 1, further comprising:

in each lift means, means for preventing rotation of said wheel interface means relative to said power means.

7. The system as recited in claim 1 in which screw drive of said lift means comprises:

means for self-contained lubrication of said screw drive.

8. An automotive lift system, comprising:

(a) a vertically elongated in-ground environment-defining canister having an upwardly directed mouth thereof;

(b) an automotive lift means;

(c) means for selectable detachable suspension of said lift means situated substantially upon and about said mouth of said canister, said suspension means comprising a horizontal truss including vertical journal means therein; and (d) means for in-ground anchoring of said suspension means relative to reactive forces generated by said lift means and communicated thereto through said suspension means.

9. The system as recited in claim 8, said canister comprising:

a pre-cast concrete pipe sealed at an end thereof opposite from said mouth to said canister.

10. The system as recited in claim 8, in which said anchoring means comprises:

a slab of rigid material extending from substantially ground level to substantially a level of said suspension means.

11. The system as recited in claim 8, in which said automotive lift means comprises:

(e) an assembly having an extensible mode and a contracted mode, an upper circumferential end of said lift means including flange means complementally positionable about said journal means to said suspension means to thereby effect the suspension of said vehicle means within said journal means; and (f) vehicle interface means secured about an upper end of said lift assembly.

12. The system as recited in claim 11, in which said assembly comprises:

a screw drive having an upper end and a lower end, said lower end including an annular thrust bearing;

power means for imparting selectable rotation to said drive screw, said means in mechanical linkage to said thrust bearing of said screw drive;

a load nut screw-threadably and non-rotationally mounted upon said screw drive;

a hollow cylinder positioned about said screw drive along substantially the entire length thereof, said cylinder non-rotationally linked to said load nut; and a hollow piston having an upper end and a lower end, positioned radially inwardly of said cylinder, having said lower end thereof rigidly mounted onto said load nut.

13. The system as recited in claim 11, further comprising:

in each lift means, means for preventing rotation of said wheel interface means relative to said power means.

14. The system as recited in claim 11, in which said screw drive of said lift means comprises:

means for self-contained lubrication of said screw drive.

* * * * *